United States Patent [19]

Ito et al.

[11] Patent Number: 4,641,031

[45] Date of Patent: Feb. 3, 1987

[54] ION SOURCE APPARATUS

[75] Inventors: Yasuyuki Ito, Yokohama; Toru Sugawara, Fujisawa, both of Japan

[73] Assignee: Kabushiki Kaisha Toshiba, Kawasaki, Japan

[21] Appl. No.: 689,943

[22] Filed: Jan. 9, 1985

[30] Foreign Application Priority Data

Feb. 13, 1984 [JP] Japan ..... 59-22732

[51] Int. Cl.[4] ..... H01J 27/00

[52] U.S. Cl. ..... 250/423 R; 376/121

[58] Field of Search ..... 250/423 R, 427; 376/121, 126, 127, 128, 150, 141; 305/111.81

[56] References Cited

U.S. PATENT DOCUMENTS

| | | | |
|---|---|---|---|
| 3,453,489 | 7/1969 | Cann et al. | 376/141 |
| 3,719,554 | 3/1973 | Cole | 376/121 |
| 4,506,160 | 3/1985 | Sugawara et al. | 250/423 R |

OTHER PUBLICATIONS

"Bulk Cathode and Its Application to Magnetic Multipole Ion Source"; Y. Itoh, T. Sugawara; Proc. *Int'l Ion Engineering Congress*-ISIAT '83 & IPAT "83-Kyoto (1983), vol. 1, p. 489 (1983).

"Characteristics of the Cleo Tokamak Ion Source", D. A. Aldcroft et al.; Culham Laboratory Rep. CLM-p. 414, 1975.

"Some Characteristics of Tungsten Filaments Operated as Cathodes in a Gas Discharge"; K. W. Ehlers and K. N. Leung; *Rev. Sci. Instrum.* 50(3), Mar. 1979.

*Primary Examiner*—Bruce C. Anderson

*Attorney, Agent, or Firm*—Oblon, Fisher, Spivak, McClelland, & Maier

[57] ABSTRACT

An ion source apparatus comprising a bulk type thermionic cathode, which, when heated, emits thermoelectrons; an anode for causing a gas discharge in cooperation with the cathode thereby producing plasma; a grid electrode for extracting ions out of the plasma; a magnetic member for confining the plasma within a prescribed region; and a ferromagnetic body which surrounds the thermionic cathode. The ferromagnetic body removes the lines of magnetic force produced by magnets from the neighborhood of the surface of the thermionic cathode. As a result, thermoelectrons are freely emitted from the thermionic cathode, thereby ensuring a stable gas discharge.

8 Claims, 1 Drawing Figure

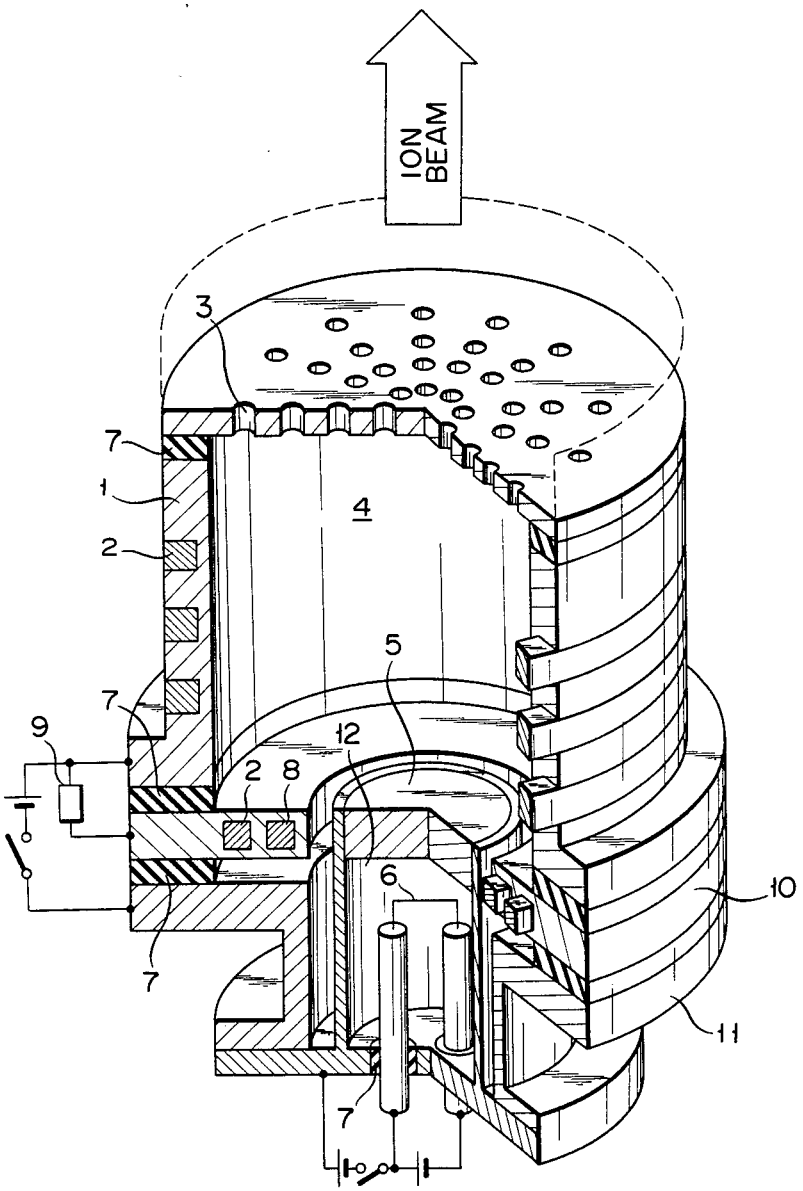
ION BEAM
3
7
1
2
4
5
7
9
12
2
8
6
10
7
11
7

ION SOURCE APPARATUS

BACKGROUND OF THE INVENTION

This invention relates to an ion source apparatus which generates plasma by means of gas discharge and which acceleratedly extracts ions from said plasma.

The conventional ion source apparatus for supplying ions to a neutral beam injector or ion implantation apparatus comprises a thermionic cathode composed of tungsten filaments, an anode, and a grid electrode to acceleratedly extract ions from plasma generated by a gas discharge occurring between a cathode and an anode. The conventional ion source apparatus arranged as described above has the drawbacks that the thermionic cathode composed of tungsten filaments loses its flesh to snap off because the cathode is heated up to high temperature and suffers from the bombardment of ions included in the plasma. Consequently, the thermionic cathode has to be frequently replaced by another one due to its short life.

To resolve the above-mentioned difficulties accompanying the conventional ion source apparatus, another ion source apparatus has been put to practical use in which a bulk cathode shaped, for example, like a disk is applied in place of the filament type of thermionic cathode. With this proposed ion source apparatus, the anode surface is surrounded by permanent magnets or electromagnets in order to effectively confine the plasma generated by the gas discharge, thereby efficiently producing ions. Such a magnet is indeed effective in confining plasma, but it is accompanied with the drawbacks that a magnetic field covers the surface of the bulk thermionic cathode to obstruct the electron emission of the cathode, thereby obstructing the gas discharge.

SUMMARY OF THE INVENTION

It is accordingly the object of this invention to provide an ion source apparatus, wherein a magnetic field for confining plasma within a prescribed region is prevented from covering the surface of a thermionic cathode, thereby enabling gas discharge to take place easily.

To attain the above-mentioned object, this invention provides an ion source apparatus comprising:

a bulk type thermionic cathode which, when heated, emits thermoelectrons;

an anode for generating a gas discharge in cooperation with said cathode thereby producing plasma;

a grid electrode for extracting ions from the plasma;

a magnet member for confining said plasma within a prescribed region; and a ferromagnetic body surrounding said thermionic cathode.

The above-mentioned ferromagnetic body eliminates the lines of magnetic force created by said magnetic member in the proximity of the surface of the thermionic cathode, thereby preventing the emission of thermoelectrons from the thermionic cathode from being obstructed by the above-mentioned lines of magnetic force, thus ensuring a stable gas discharge. Said ferromagnetic body may assume any shape, provided it can eliminate the occurrence of the lines of magnetic force in the neighborhood of the surface of the thermionic cathode. Further, said ferromagnetic body may be provided at any position on the periphery of the thermionic cathode. For instance, it is possible to use a ring-shaped ferromagnetic body. As occasion demands, a plurality of ferromagnetic bodies may be arranged around the thermionic cathode. The ferro-magnetic body may be prepared from, for example, ferrite steel.

BRIEF DESCRIPTION OF THE DRAWING

The attached drawing is an oblique sectional view of an ion source apparatus embodying this invention.

DETAILED DESCRIPTION OF THE PREFERRED EMBODIMENT

A description may now be made with reference to the accompanying drawing of an ion source apparatus embodying this invention.

The ion source apparatus of FIG. 1 is fundamentally comprised of a main discharge chamber 4 and an auxiliary discharge chamber 12. The main discharge chamber 4 consists of an anode 1 constituting a discharge chamber wall, grid electrode 3 for extracting ion beams out of the main discharge chamber 4, disk-shaped thermionic cathode 5 for emitting thermoelectrons, and conductive plate 10. Permanent magnets 2 are attached to or embedded in the conductive plate 10 to effectively confine the plasma generated in the main discharge chamber 4 by means of gas discharge. The conductive plate 10 is electrically connected to the anode 1 by means of a resistor 9. The disk-shaped thermionic cathode 5 is heated by the bombardment of electrons released from the tungsten filament 6 provided in the auxiliary discharge chamber 12 and heated by passing an electric current therethrough. Said electrons are accelerated by an electric field applied between the thermionic cathode 5 and tungsten filament 6. The auxiliary discharge chamber 12 is evacuated to allow the thermoelectrons to freely travel from the tungsten filament 6 to the cathode 5. A ring 8 constituted by a ferromagnetic body prepared from, for example, ferrite steel is embedded in the conductive plate 10. If the surface of the thermionic cathode 5 is covered with the lines of magnetic force generated by the permanent magnets 2, the emission of electrons from the thermionic cathode 5 will be obstructed. However, the above-mentioned ring 8 removes said magnetic force from the surface of the thermionic cathode 5, thereby ensuring the free emission of electrons from the thermionic cathode 5. An insulator 7 electrically insulates between the anode 1 and conductive plate 10, between said conductive plate 10 and a thermionic cathode-fitting flange 11 electrically connected to said thermionic cathode 5, and between said thermionic cathode 5 and tungsten filament 6.

An ion source apparatus embodying this invention which is arranged as described above causes ion beams to be drawn off in the following manner. First, D.C. voltage is applied on the tungsten filament 6 held in the evacuated auxiliary discharge chamber 12 to heat said tungsten filament 6. As a result, electrons are emitted from the surface of said heated tungsten filament 6. When D.C. voltage is applied between the thermionic cathode 5 and tungsten filament 6, electrons are accelerated by a potential difference between both elements 5, 6 and bombard the thermionic cathode 5, which in turn is heated. The main discharge chamber 4 is filled with, for example, hydrogen gas through a gas inlet (not shown). When D.C. voltage is applied between the thermionic cathode 5 and anode 1, electrons are emitted from the surface of the heated thermionic cathode 5. Thus, arc discharges are generated to provide a gas plasma. In this case, the plasma contains, for example, hydrogen ions produced by collision between the electrons and gas molecules. Said hydrogen ions are accelerated by the grid electrode 3 and are extracted in the form of ion beams. On this occasion, the plasma is effectively confined within a discharge chamber by means of the permanent magnets 2 embedded in the anode 1 and the conductive plate 10. As a result, ion beams are effectively extracted from said discharge chamber. If, however, the surface of the thermionic cathode 5 is covered with the lines of magnetic force generated by the permanent magnets 2, then the emission of electrons from the thermionic cathode 5 will be obstructed, presenting difficulties in the effective extraction of ion beams. With the ion source apparatus of this invention indicated in the attached drawing, the thermionic cathode 5 is surrounded by a ring consisting of a ferromagnetic body to remove the lines of magnetic force from the surface of the thermionic cathode 5, thereby ensuring the free emission of thermoelectrons from the thermionic cathode 5.

With the indicated embodiment, the conductive plate 10 is fitted with permanent magnets 2 and a ferromagnetic body. However, it is possible to omit said conductive plate 10 and couple the flange of the anode 1 with the thermionic cathode-fitting flange 11 with electric insulation maintained therebetween. In this case, it is necessary to fit the permanent magnets 2 and ring 8 to the flange 11.

With the foregoing embodiment, a disk-shaped thermionic cathode 5 was used. However, said thermionic cathode 5 may assume any other form as occasion demands. Further, the ferromagnetic body 8 need not be fabricated in the form of a ring, but may be made in any other form, provided it assumes such a shape as enables the lines of magnetic force to be removed from the neighborhood of the surface of the thermionic cathode 5. In other words, it is possible to surround the thermionic cathode 5 with divided portion of said ferromagnetic body 8. The foregoing embodiment involved an assembly of the thermionic cathode 5 and ferromagnetic body 8. However, it is possible to apply a plurality of said assemblies.

With the aforementioned embodiment, the thermionic cathode 5 was heated by the bombardment of thermoelectrons emitted from the tungsten filament 6. However, this invention is applicable in another modification. Namely, said bulk cathode 6 may be heated by the heat radiated from a heated body. Further, the tungsten filament 6 may be replaced by a plate-shaped auxiliary electrode. Namely, the thermionic cathode 5 may be heated by the bombardment of thermoelectrons emitted from said auxiliary electrode. Further, the permanent magnets may be replaced by electromagnets.

What is claimed is:

1. An ion source apparatus comprising:

a bulk type thermionic cathode which, when heated, emits thermoelectrons;

an anode which causes a discharge in cooperation with said thermionic cathode, thereby producing a plasma;

a grid electrode for extracting ions out of said plasma;

a mangetic member for confining said plasma within a prescribed region; and a ferromagnetic body surrounding said thermionic cathode for eliminating lines of magnetic force created by said magnetic member in proximity to the surface of said thermionic cathode.

2. The ion source apparatus according to claim 1, wherein said ferromagnetic body assumes a ring shape.

3. The ion source apparatus according to claim 1, wherein said ferromagnetic body is made of ferrite steel.

4. The ion source apparatus according to claim 1, wherein said anode constitutes the wall of a discharge chamber.

5. The ion source apparatus according to claim 4, wherein the end of said discharge chamber wall constituted by said anode is fitted with a conductive plate, said conductive plate having a central hole allowing for the insertion of said thermionic cathode, and said ferromagnetic body is embedded in said conductive plate.

6. The ion source apparatus according to claim 5, wherein a magnetic member is embedded in said conductive plate.

7. The ion source apparatus according to claim 4, wherein a magnetic member is provided in said discharge chamber wall.

8. The ion source apparatus according to claim 1, wherein a filament connected to a D.C. power supply is made to face that side of the thermionic cathode which is opposite to the region in which said discharge is generated, and wherein one end of said filament and said thermionic cathode are connected to another D.C. power supply.

* * * * *